US008201821B2

(12) United States Patent
Ohno et al.

(10) Patent No.: US 8,201,821 B2
(45) Date of Patent: Jun. 19, 2012

(54) PAPER FEEDING CASSETTE

(75) Inventors: Masahiro Ohno, Yokohama (JP); Kazumasa Yasui, Arakawa-ku (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/158,339

(22) Filed: Jun. 10, 2011

(65) Prior Publication Data

US 2011/0241284 A1 Oct. 6, 2011

Related U.S. Application Data

(62) Division of application No. 12/543,765, filed on Aug. 19, 2009, now Pat. No. 7,984,901.

(60) Provisional application No. 61/090,179, filed on Aug. 19, 2008, provisional application No. 61/090,173, filed on Aug. 19, 2008, provisional application No. 61/090,172, filed on Aug. 19, 2008.

(51) Int. Cl.
*B65H 1/00* (2006.01)

(52) U.S. Cl. ..... 271/145; 271/162

(58) Field of Classification Search ..... 271/162, 271/145

See application file for complete search history.

(56) References Cited

U.S. PATENT DOCUMENTS

| | | | | |
|---|---|---|---|---|
| 5,364,088 | A * | 11/1994 | Maruyama et al. | 271/164 |
| 5,823,647 | A * | 10/1998 | Miyoshi | 312/333 |
| 5,845,899 | A * | 12/1998 | Satoh et al. | 271/9.11 |
| 6,039,315 | A | 3/2000 | Lim | |
| 6,575,453 | B2 | 6/2003 | Chiang | |
| 6,783,126 | B2 | 8/2004 | Amamoto | |
| 7,457,580 | B2 | 11/2008 | Kitamura | |
| 7,731,180 | B2 * | 6/2010 | Ohnishi | 271/164 |
| 7,850,164 | B2 * | 12/2010 | Ahn et al. | 271/162 |
| 7,862,034 | B2 * | 1/2011 | Kobayashi | 271/145 |
| 2003/0116906 | A1 | 6/2003 | Amamoto | |

FOREIGN PATENT DOCUMENTS

| | | |
|---|---|---|
| JP | 07-109034 | 4/1995 |
| JP | 08-012101 | 1/1996 |
| JP | 09-301545 | 11/1997 |
| JP | 2002-321833 | 11/2002 |
| JP | 2002-362757 | 12/2002 |
| JP | 2006-256776 | 9/2006 |
| JP | 2008-169027 | 7/2008 |

* cited by examiner

*Primary Examiner* — Kaitlin Joerger
(74) *Attorney, Agent, or Firm* — Patterson & Sheridan, LLP

(57) ABSTRACT

A paper feeding cassette includes: a cassette case configured to store sheets; a sheet tray on which the sheets are stacked, the sheet tray being rotatably attached to the cassette case; a push-up member configured to push up the sheet tray and rotate the sheet tray in one direction when driving force is input and release the push-up of the sheet tray to allow rotation of the sheet tray in the other direction when the input of the driving force is interrupted; and a buffer member configured to be nipped by the cassette case and the sheet tray and elastically deformed when the sheet tray rotates in the other direction. The buffer member is located, when viewed from a stacking direction of the sheets, in an area closer to a rotation axis of the sheet tray than a distal end of the sheet tray that is most distant from the rotation axis in the sheet tray.

5 Claims, 21 Drawing Sheets

PAPER FEEDING CASSETTE

CROSS-REFERENCE TO RELATED APPLICATION

This application is a divisional of U.S. patent application Ser. No. 12/543,765, filed Aug. 19, 2009, which is based upon and claims the benefit of priority from: U.S. provisional application 61/090,173 filed on Aug. 19, 2008; U.S. provisional application 61/090,172, filed on Aug. 19, 2008; and U.S. provisional application 61/090,179, filed on Aug. 19, 2008, the entire contents of each of which are incorporated herein by reference.

TECHNICAL FIELD

The present invention relates to a paper feeding cassette in which sheets to be fed to an image forming unit are stacked.

BACKGROUND

In an image forming apparatus, sheets stacked in a paper feeding cassette are sequentially fed to an image forming unit and images are formed on the sheets. The sheets stacked in the paper feeding cassette are pushed up by a sheet tray and brought into contact with a pickup roller. If the pickup roller is rotated, the sheets can be delivered from the paper feeding cassette.

When the paper feeding cassette is inserted in an image forming apparatus main body (hereinafter referred to as apparatus main body), the sheet tray is subjected to driving force from the apparatus main body and pushed up. On the other hand, when the sheet feeding cassette is drawn out from the apparatus main body, the force for pushing up the sheet tray is released and the sheet tray falls. The sheet tray collides with a cassette case of the paper feeding cassette and collision sound may be caused.

SUMMARY

According to an aspect of the present invention, there is provided a paper feeding cassette including: a cassette case configured to store sheets; a sheet tray on which the sheets are stacked, the sheet tray being rotatably attached to the cassette case; a push-up member configured to push up the sheet tray and rotate the sheet tray in one direction when driving force is input and release the push-up of the sheet tray to allow rotation of the sheet tray in the other direction when the input of the driving force is interrupted; and a buffer member configured to be nipped by the cassette case and the sheet tray and elastically deformed when the sheet tray rotates in the other direction. The buffer member is located, when viewed from a stacking direction of the sheets, in an area closer to a rotation axis of the sheet tray than a distal end of the sheet tray that is most distant from the rotation axis in the sheet tray.

According to another aspect of the present invention, there is provided a paper feeding apparatus including: a paper feeding cassette configured to be inserted in and removed from an apparatus main body by slide operation and have a pair of sidewalls opposed to each other in a direction orthogonal to a sliding direction; a cassette rail configured to have a bottom surface that supports a flange section projecting to an outer side of the paper feeding cassette from one sidewall and a side surface opposed to a distal end surface of the flange section; and a holding lever configured to come into contact with, when the paper feeding cassette is slid, a projection formed on the other sidewall to thereby rotate around an axis orthogonal to a slide surface of the paper feeding cassette and configured to detachably hold the projection. The distal end surface of the flange section has areas having different distances from the side surface of the cassette rail.

According to still another aspect of the present invention, there is provided a paper feeding apparatus including: a paper feeding cassette in which sheets are stacked; an apparatus main body in which the paper feeding cassette is inserted; a switch element configured to be pushed by the paper feeding cassette being in an insertion position and output information concerning a size of the sheets stacked in the paper feeding cassette; and a supporting member configured to be provided in the apparatus main body and support the switch element in a state in which the switch element can be displaced in a moving direction of the paper feeding cassette.

DETAILED DESCRIPTION

Embodiments of the present invention are explained below with reference to the accompanying drawings.

First Embodiment

Figure 1:
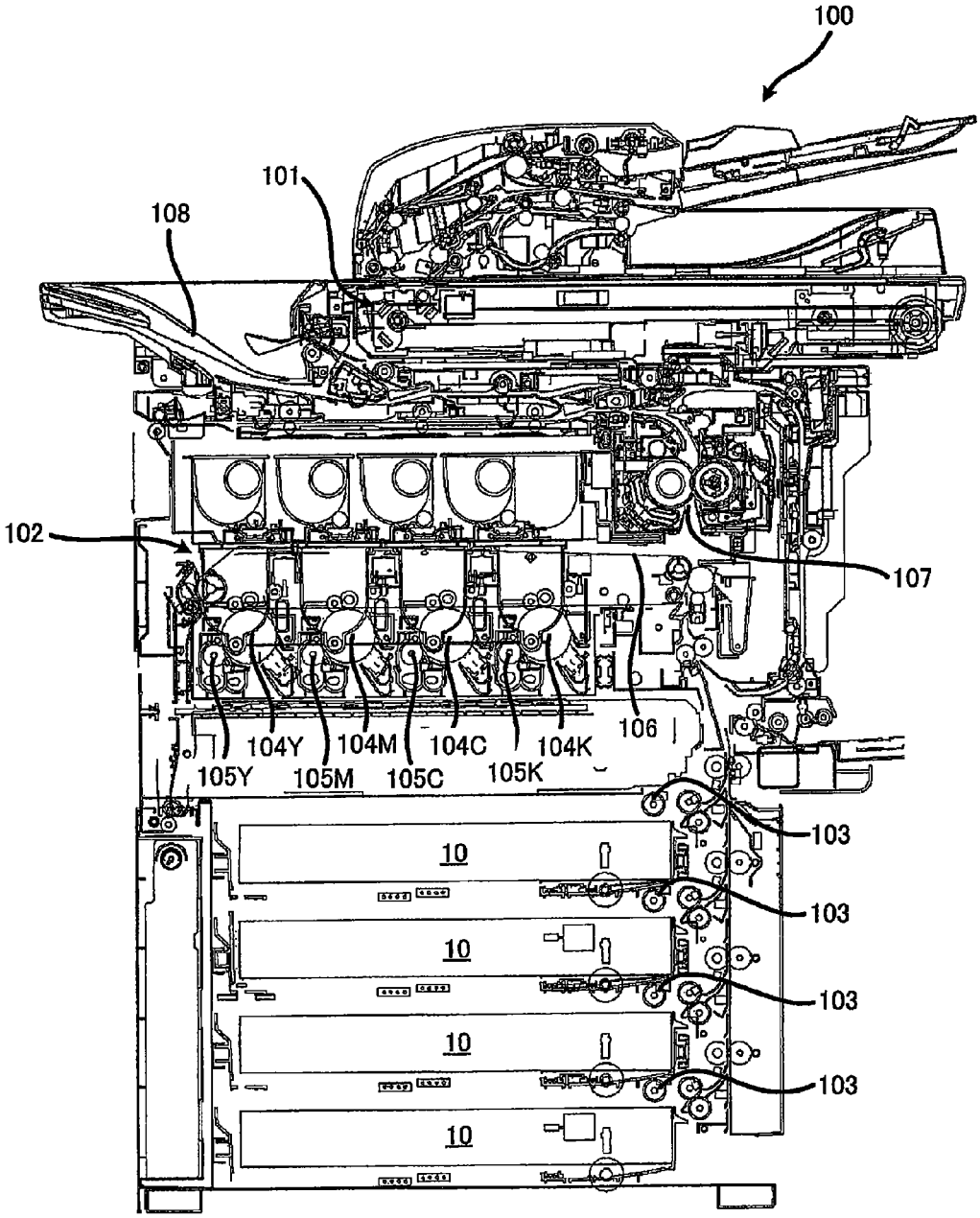
FIG. 1 is a sectional view of a configuration of an image processing apparatus according to a first embodiment of the present invention.

A paper feeding cassette according to a first embodiment of the present invention is explained. First, an image processing apparatus including the paper feeding cassette according to this embodiment is explained with reference to FIG. 1. FIG. 1 is a longitudinal sectional view of a schematic configuration of the image processing apparatus (MFP: Multi Function Peripheral).

As shown in FIG. 1, an image processing apparatus 100 according to this embodiment includes an image reading section 101 and an image forming section 102.

The image reading section 101 has a function of scanning and reading images of a sheet document and a book document. The image forming section 102 has a function of forming a developer image on a sheet on the basis of image data generated by reading operation of the image reading section 101, image data transmitted from an external apparatus (e.g., a personal computer) to the image processing apparatus 100, and the like.

As an example of processing in the image processing apparatus 100 according to this embodiment, an overview of copy processing is explained below.

First, a sheet picked up from a paper feeding cassette 10 by a pickup roller 103 is fed into a sheet conveying path. The sheet fed into the sheet conveying path is conveyed in a predetermined conveying direction by plural roller pairs.

Subsequently, electrostatic latent images are formed on photoconductive surfaces of photoconductive members 104Y, 104M, 104C, and 104K on the basis of image data generated by the reading operation of the image reading section 101. The photoconductive members 104Y to 104K are used for transferring developer images of yellow (Y), magenta (M), cyan (C), and black (K) onto the sheet.

Developers are supplied to the photoconductive members 104Y to 104K, on which the electrostatic latent images are formed, by developing rollers (so-called mug rollers) 105Y to 105K. Consequently, the electrostatic latent images formed on the photoconductive surfaces of the photoconductive members 104Y to 104K are visualized.

Developer images formed on the photoconductive members 104Y to 104K are transferred onto a belt surface of an intermediate transfer belt 106 (so-called primary transfer). The developer images conveyed according to the rotation of the intermediate transfer belt 106 are transferred onto the conveyed sheet in a predetermined secondary transfer position.

The developer images transferred on the sheet are heated and fixed on the sheet by a fixing device 107. The sheets on which the developer images are heated and fixed is conveyed through the conveying path by plural conveying roller pairs and discharged onto a discharge tray 108.

Figure 2:
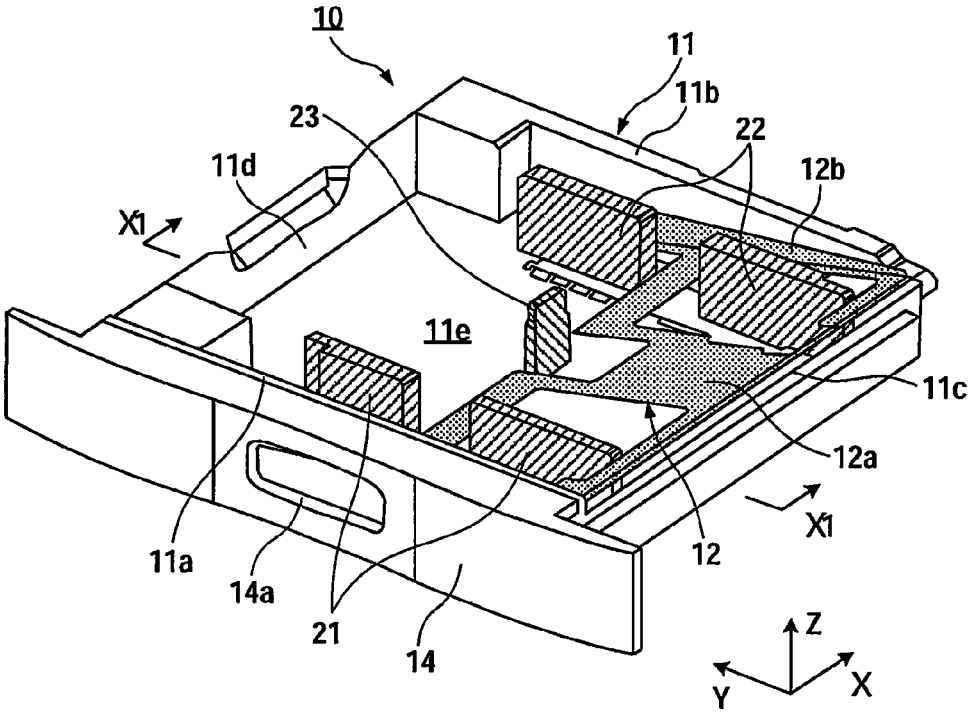
FIG. 2 is an external view of a paper feeding cassette according to the first embodiment.

The structure of the paper feeding cassette 10 in this embodiment is explained with reference to FIG. 2. The paper feeding cassette 10 can be inserted into an apparatus main body and drawn out from the apparatus main body by being slid in an X direction. An X axis, a Y axis, and a Z axis shown in FIG. 2 are axes orthogonal to one another. The Z axis is an axis equivalent to the vertical direction of the image processing apparatus 100. A relation among the X axis, the Y axis, and the Z axis is the same in the other drawings.

In this embodiment, a section of the apparatus main body in which the paper feeding cassette 10 is inserted may be configured integrally with the image forming section 102 or may be configured as a separate member.

The paper feeding cassette 10 includes a cassette case 11 and a sheet tray 12. The cassette case 11 includes sidewalls 11*a* and 11*b* opposed to each other in the X direction, sidewalls 11*c* and 11*d* opposed to each other in a Y direction, and a bottom 11*e*. The cassette case 11 forms a space in which plural sheets can be stored.

The sheet tray 12 is rotatably attached to the cassette case 11. Plural sheets are stacked on the sheet tray 12.

A first side guide 21 and a second side guide 22 are used for positioning, in the X direction, sheets stacked on the sheet tray 12. The first side guide 21 and the second side guide 22 are attached to the cassette case 11 to be slidable in the X direction. The first side guide 21 and the second side guide 22 come close to and separate from each other in the X direction. A space between the first side guide 21 and the second side guide 22 can be changed according to a size of sheets. A trailing end guide 23 is used for positioning, in the Y direction, the sheets on the sheet tray 12. The trailing end guide 23 is attached to the cassette case 11 to be slidable in the Y direction.

The sheet tray 12 includes a stacking plate 12*a* and a pair of side plates 12*b*. The stacking plate 12*a* has an area in which sheets are stacked. The stacking plate 12*a* is formed in a shape for avoiding an area in which the side guides 21 and 22 and the trailing end guide 23 can move. The pair of side plates 12*b* (in FIG. 2, one side plate 12*b* is shown) opposed to each other in the X direction extend in a direction orthogonal to the stacking plate 12*a* and are arranged along the pair of sidewalls 11*a* and 11*b* in the cassette case 11.

A front cover 14 is fixed to the sidewall 11*a*. The front cover 14 configures an armor of the image processing apparatus 100 when the paper feeding cassette 10 is inserted in the apparatus main body. An operating section 14*a* of the front cover 14 is operated, for example, when the paper feeding cassette 10 is drawn out from the apparatus main body.

Figure 3:
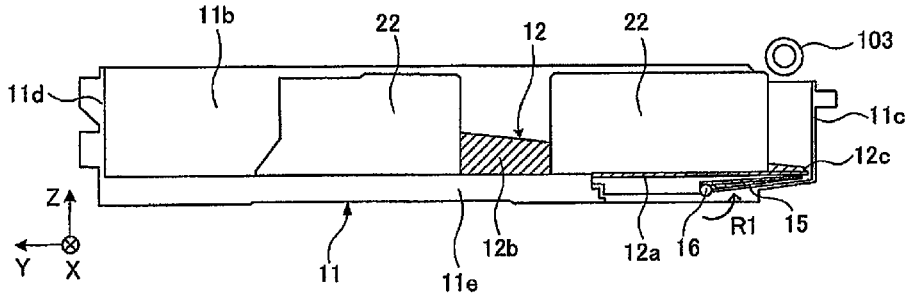
FIGS. 3 to 5 are sectional views taken along X1-X1 in FIG. 2 and are diagrams for explaining the operation of a sheet tray.
Figure 4:
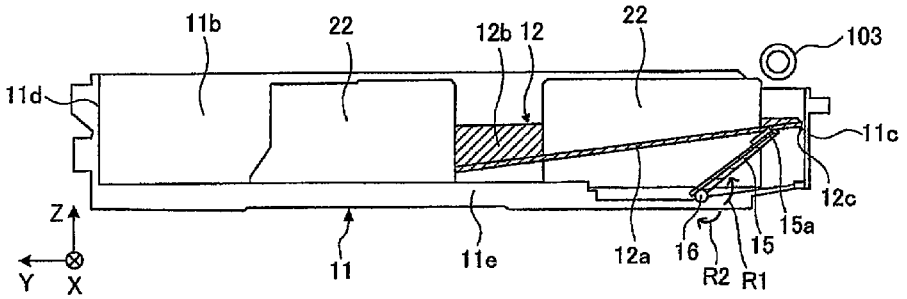
Figure 5:
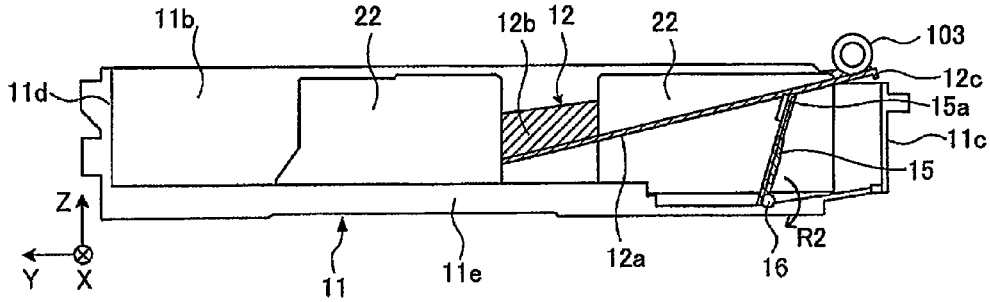

FIGS. 3 to 5 are sectional views taken along X1-X1 in FIG. 2 and are diagrams for explaining the operation of the sheet tray 12. As shown in FIGS. 3 to 5, a push-up lever (a push-up member) 15 is arranged between the bottom 11*e* of the cassette case 11 and the sheet tray 12. The push-up lever 15 is attached to the bottom 11*e* of the cassette case 11 in a rotatable state. Specifically, the push-up lever 15 rotates around a coupling shaft 16 that extends in the X direction.

Figure 6:
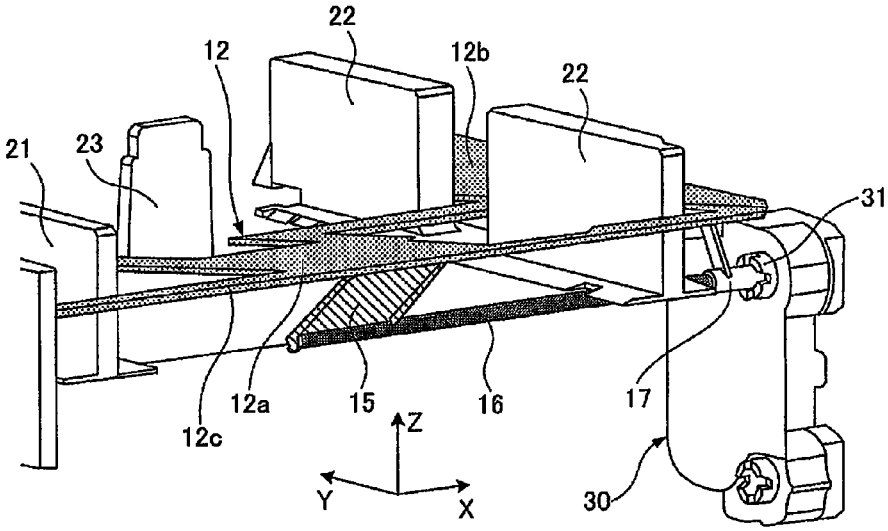
FIG. 6 is an external view of a mechanism for driving the sheet tray.

As shown in FIG. 6, a coupling 17 is fixed to one end of the coupling shaft 16. A driving unit 30 including a driving coupling 31 is provided in the apparatus main body.

When the paper feeding cassette 10 is inserted in the apparatus main body, the coupling 17 is coupled to the driving coupling 31. The driving coupling 31 is connected to a motor (not shown) and is subjected to driving force from the motor and rotates. When the driving coupling 31 and the coupling 17 are coupled, the coupling shaft 16 is subjected to rotating force from the driving coupling 31 and rotates.

In a state shown in FIG. 3, when the coupling shaft 16 is rotated in a direction of an arrow R1, the push-up lever 15 also rotates in the same direction (the direction of the arrow R1). When the push-up lever 15 rotates in the direction of the arrow R1, as shown in FIG. 4, a distal end 15*a* of the push-up lever 15 pushes up the sheet tray 12. As shown in FIG. 5, the push-up lever 15 can rotate in the direction of the arrow R1 until the sheet tray 12 comes into contact with the pickup roller 103.

Plural sheets are stacked on the sheet tray 12. Since the sheet tray 12 rotates in the direction of the arrow R1, the sheets on the sheet tray 12 can be pressed against the pickup roller 103. The sheets on the sheet tray 12 are fed to the sheet conveying path one by one according to the rotation of the pickup roller 103.

As the number of sheets on the sheet tray 12 decreases, the sheet tray 12 further rotates in the direction of the arrow R1. When no sheet is left on the sheet tray 12, the sheet tray 12 comes into contact with the pickup roller 103. Information indicating that no sheet is left in the paper feeding cassette 10 can be notified to a user by sound or display.

When sheets are supplied to the paper feeding cassette 10, the paper feeding cassette 10 is drawn out from the apparatus main body. When the paper feeding cassette 10 is drawn out, since the coupling 17 comes off from the driving coupling 31, the push-up lever 15 falls while rotating in a direction of an arrow R2 (opposite to the direction of the arrow R1) because of the weight of the push-up lever 15 or the weight of the sheet tray 12. The sheet tray 12 also falls while rotating in the direction of the arrow R2 according to the rotation of the push-up lever 15.

Figure 7:
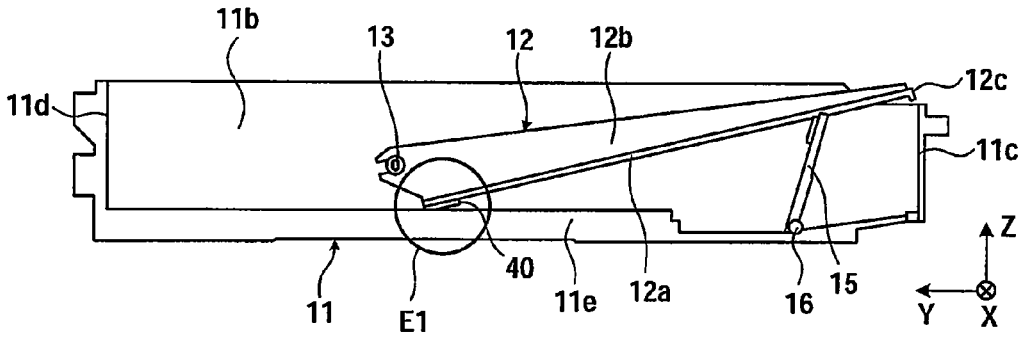
FIG. 7 is a diagram of a position where a buffer rubber is arranged.

As shown in FIG. 7, elastically deformable buffer rubbers (buffer members) 40 are provided at ends on a shaft section 13 side in the stacking plate 12*a* of the sheet tray 12. FIG. 7 is a diagram corresponding to FIG. 5. The shaft section 13 rotatably supports the side plates 12*b* of the sheet tray 12 and is provided in the sidewalls 11*a* and 11*b* of the cassette case 11.

Figure 8:
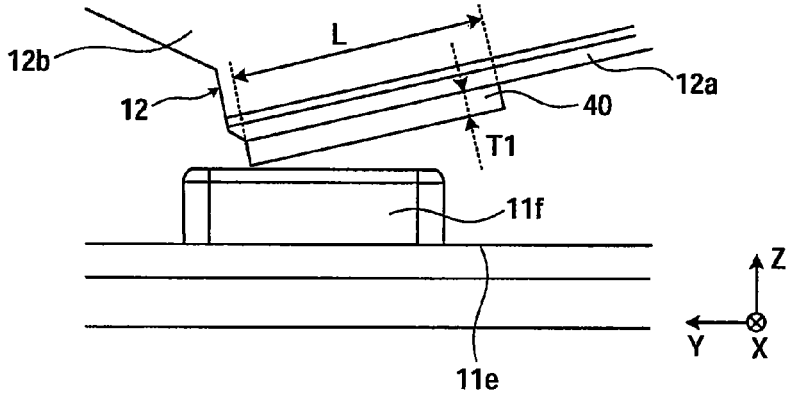
FIG. 8 is an enlarged view in an area E1 shown in FIG. 7.

FIG. 8 is an enlarged view in an area E1 shown in FIG. 7. The buffer rubbers 40 have uniform thickness T1 and are arranged along the stacking plate 12*a*. Projections 11*f* that come into contact with the buffer rubbers 40 are formed in the sidewalls 11*a* and 11*b* of the cassette case 11. Length L of the buffer rubbers 40 can be set as appropriate.

Figure 9:
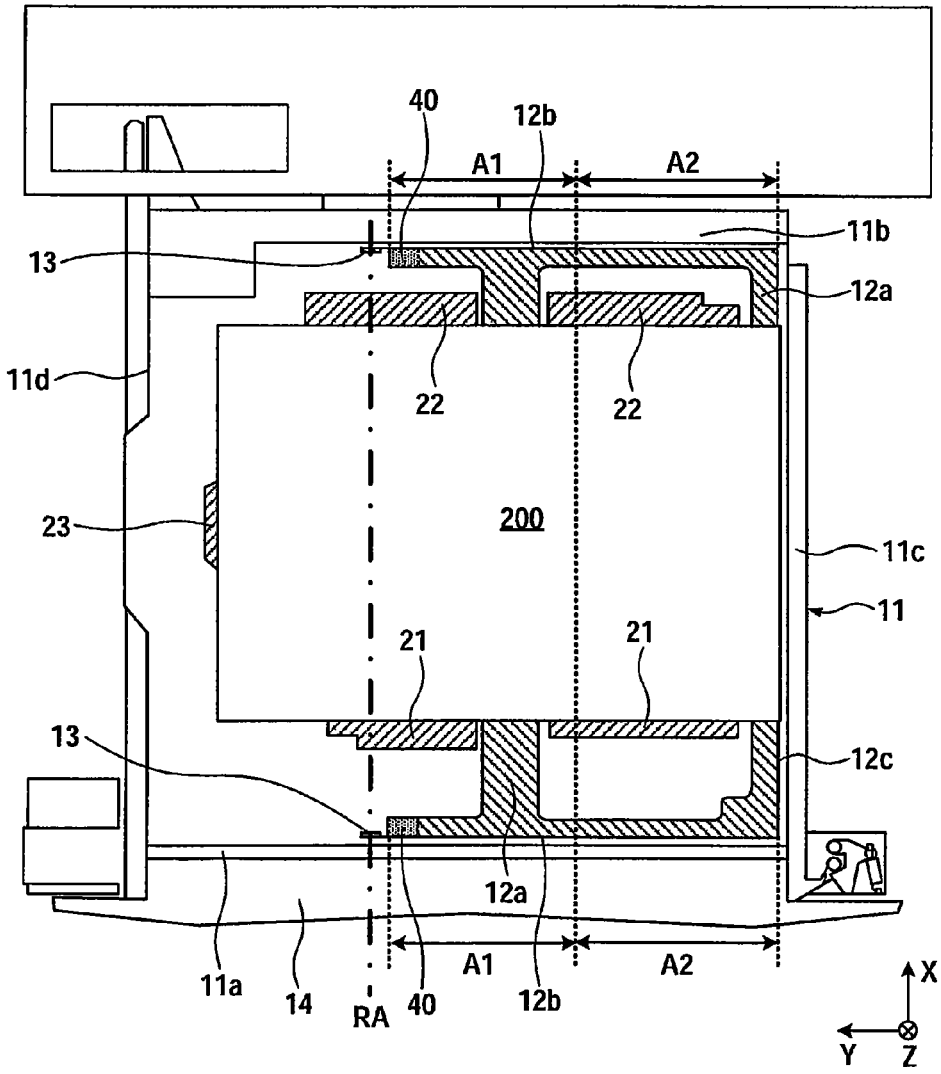
FIG. 9 is a diagram of the paper feeding cassette viewed from a stacking direction of sheets.

As shown in FIG. 9, the buffer rubbers 40 are located further on a side of a rotation axis RA than a distal end 12*c* of the sheet tray 12. FIG. 9 is a diagram of the paper feeding cassette 10 viewed from above (a Z direction). The distal end 12*c* is an end that is most distant from the rotation axis RA of the sheet tray 12. A moving distance of the distal end 12*c* is the longest with respect to a rotation amount of the sheet tray 12. The rotation axis RA is a rotation axis of the sheet tray 12.

As shown in FIG. 9, the buffer rubbers 40 are located in areas different from an area in which sheets 200 are stacked in the stacking plate 12*a*. The area in which the sheets 200 are stacked changes according to positions of the first side guide 21 and the second side guide 22. The areas in which the buffer rubbers 40 are arranged in the stacking plate 12*a* are located further on a side of the sidewall 11*a* (or 11*b*) than the first side guide 21 (or 22) and are areas in which the sheets 200 are not stacked.

In this embodiment, the buffer rubbers 40 are provided in sections closest to the rotation axis RA in the stacking plate 12*a*. However, the positions of the buffer rubbers 40 are not limited to this. Specifically, the buffer rubbers 40 only have to be located within an area A1 shown in FIG. 9. The area A1 shown in FIG. 9 is an area closer to the rotation axis RA than the distal end 12*c*. The area A2 is an area closer to the distal end 12*c* than the rotation axis RA.

When the paper feeding cassette 10 is drawn out from the apparatus main body, the sheet tray 12 falls as explained above. When the sheet tray 12 falls, since the buffer rubbers 40 are nipped by the sheet tray 12 (the stacking plate 12*a*) and the projections 11*f* and elastically deformed, falling speed (rotating speed) of the sheet tray 12 can be reduced. In other words, falling energy of the sheet tray 12 can be absorbed by the elastic deformation of the buffer rubbers 40.

When the sheet tray 12 starts to fall from the position shown in FIG. 7, the buffer rubbers 40 may be in contact with the projections 11*f* or may be separated from the projections 11*f*. According to the fall of the sheet tray 12, a contact area between the buffer rubbers 40 and the projections 11*f* increases. Therefore, as the distal end 12*c* of the sheet tray 12 comes closer to the bottom 11*e* of the cassette case 11, it becomes easier to reduce the rotating speed of the sheet tray 12.

Figure 10:
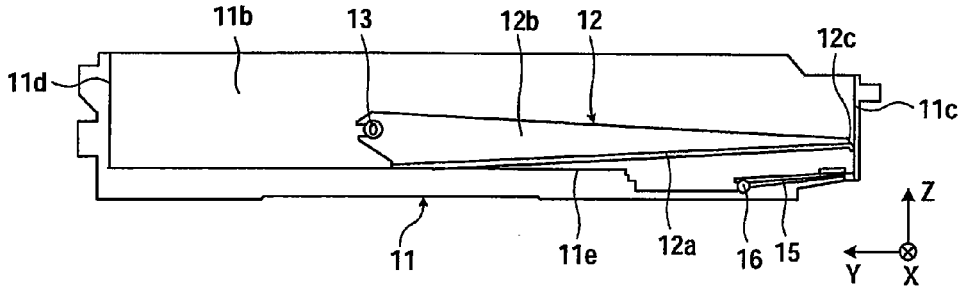
FIG. 10 is a sectional view of the paper feeding cassette in a state in which the sheet tray is stopped.

In this embodiment, as shown in FIG. 10, when the rotation of the sheet tray 12 stops, the distal end 12*c* of the sheet tray 12 is separated from the bottom 11*e* of the cassette case 11. In a state shown in FIG. 10, sheets are not stacked on the sheet tray 12.

If the distal end 12*c* is stopped in a position away from the bottom 11*e*, when the sheet tray 12 falls, the distal end 12*c* can be prevented from moving beyond a stop position shown in FIG. 10 and colliding with the bottom 11*e*. In other words, the fall of the sheet tray 12 can be stopped before the distal end 12*c* collides with the bottom 11*e*. Even if the distal end 12*c* collides with the bottom 11*e*, energy during the collision can be reduced.

The sheet tray 12 can be stopped in the position shown in FIG. 10 by appropriately setting the hardness (including a characteristic of a material itself) and the size (including the thickness T1 and the length L shown in FIG. 8) of the buffer rubbers 40.

Figure 11:
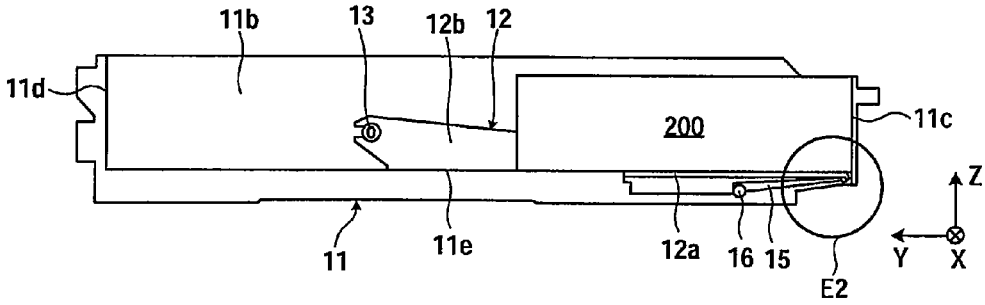
FIG. 11 is a diagram of a state in which the sheets are stacked on the sheet tray.
Figure 12:
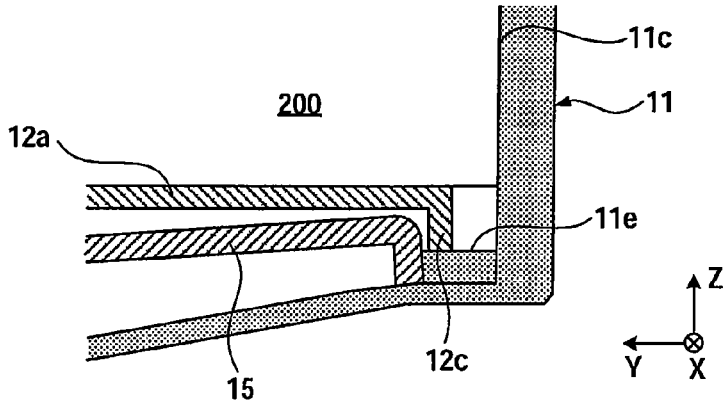
FIG. 12 is an enlarged view in an area E2 shown in FIG. 11.

On the other hand, when plural sheets 200 are stacked on the sheet tray 12 in the state shown in FIG. 10, the sheet tray 12 rotates because of the weight of the sheets 200 and the distal end 12*c* comes into contact with the bottom 11*e* (see FIG. 11). An enlarged view in an area E2 shown in FIG. 11 is shown in FIG. 12.

Figure 13:
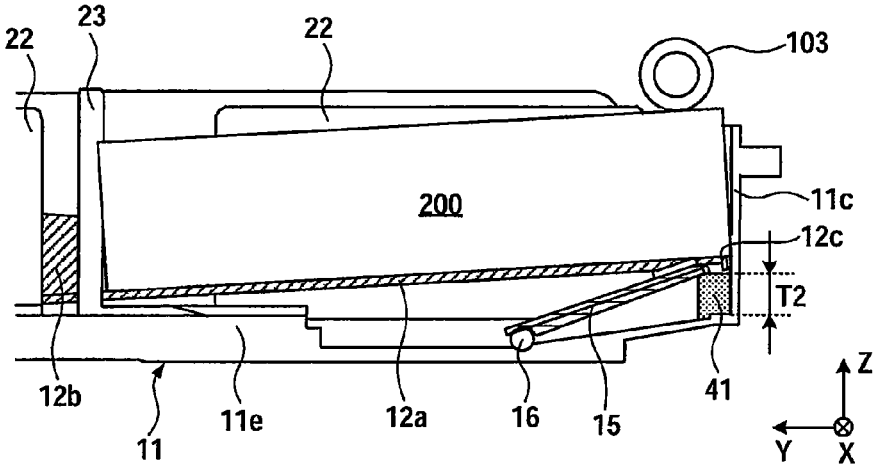
FIG. 13 is a diagram of a configuration in which a buffer rubber is arranged in a position where a distal end of the sheet tray falls.

As structure for preventing the sheet tray 12 from colliding with the cassette case 11, structure shown in FIG. 13 is also conceivable. In the structure shown in FIG. 13, buffer rubbers 41 are arranged between the distal end 12*c* of the sheet tray 12 and the bottom 11*e* of the cassette case 11.

However, in the structure shown in FIG. 13, the number of sheets 200 stacked on the sheet tray 12 may decrease. Further, in the vertical direction (the Z direction) of the image processing apparatus 100, the paper feeding cassette 10 may be increased in size.

When the sheet tray 12 falls, a moving distance of the distal end 12*c* is the longest. Therefore, in order to reduce impact energy of the distal end 12*c*, it is necessary to increase thickness T2 of the buffer rubbers 41. Although the buffer rubbers 41 are elastically deformed, an amount of deformation is limited. Therefore, as shown in FIG. 13, even if the plural sheets 200 are stacked on the sheet tray 12, the distal end 12*c* of the sheet tray 12 separates from the bottom 11*e* of the cassette case 11.

The number of sheets 200 stacked on the sheet tray 12 decreases by a distance between the distal end 12*c* of the sheet tray 12 and the bottom 11*e* of the cassette case 11.

On the other hand, if the paper feeding cassette 10 is increased in size in the Z direction, the number of sheets 200 stacked on the sheet tray 12 can be increased. However, the image processing apparatus 100 is increased in size by the increase in the size of the paper feeding cassette 10.

In this embodiment, as shown in FIGS. 7 and 8, the buffer rubbers 40 are provided in areas in which the moving distance during the fall is the shortest (in other words, areas in which the moving speed is the lowest) in the sheet tray 12. Therefore, impact on the sheet tray 12 during the fall can be reduced even if the thickness T1 of the buffer rubbers 40 is set smaller than the thickness T2 of the buffer rubbers 41 shown in FIG. 13.

Since the thickness T1 of the buffer rubbers 40 is set small, the buffer rubbers 40 can be deformed by the weight of the sheets 200 stacked on the sheet tray 12 and the sheet tray 12 can be brought close to the bottom 11*e* of the cassette case 11. Therefore, the number of sheets 200 stacked on the sheet tray 12 does not decrease.

The thickness T1 of the buffer rubbers 40 does not have to be uniform. A shape of the buffer rubbers 40 can be set as appropriate. For example, if upper surfaces of the projections 11*f* incline with respect to the bottom 11*e* of the cassette case 11, slopes can be formed in the buffer rubbers 40 along the upper surfaces (slopes) of the projections 11*f*.

In this embodiment, the buffer rubbers 40 are arranged at the ends closest to the shaft section 13 in the stacking plate 12*a* of the sheet tray 12. However, the positions of the buffer rubbers 40 are not limited to this. The buffer rubbers 40 only have to be located within the area A1 shown in FIG. 9.

In the area A1, the thickness T1 of the buffer rubbers 40 attached to areas closer to the rotation axis RA can be set smaller. As the thickness T1 of the buffer rubbers 40 is set smaller, when the sheets 200 are stacked on the sheet tray 12, the distal end 12*c* of the sheet tray 12 can be more easily brought into contact with the bottom 11*e* of the cassette tray 11.

The buffer rubbers 40 can be provided in the cassette tray 11 rather than the sheet tray 12. The buffer rubbers 40 can be provided in both the sheet tray 12 and the cassette tray 11. In this case, the buffer rubbers 40 can also be provided in the position explained in this embodiment.

A mechanism for pushing up the sheet tray 12 is not limited to the mechanism including the push-up lever 15. In other words, the mechanism only has to be capable of rotating the sheet tray 12 in the direction of the arrow R1 shown in FIG. 3. When the paper feeding cassette 10 is drawn out from the apparatus main body, force (push-up force) acting on the sheet tray 12 only has to be released.

In this embodiment, the buffer rubbers 40 are used. However, springs can be use instead of the rubbers. Even if the springs are used, the falling speed of the sheet tray 12 can be reduced. If the rubbers are used, the sheet tray 12 is easily stopped in the predetermined stop position (see FIG. 10).

In this embodiment, the buffer rubbers 40 are brought into contact with the projections 11*f* formed on the sidewalls 11*a* and 11*b* of the cassette tray 11. However, the positions of the buffer rubbers 40 are not limited to this. For example, the buffer rubbers 40 can be arranged on the bottom 11*e* of the cassette tray 11 without providing the projections 11*f*.

Second Embodiment

A paper feeding cassette according to a second embodiment of the present invention is explained. Members having the same functions as those of the members explained in the first embodiment are denoted by the same reference numerals and signs.

Figure 14:
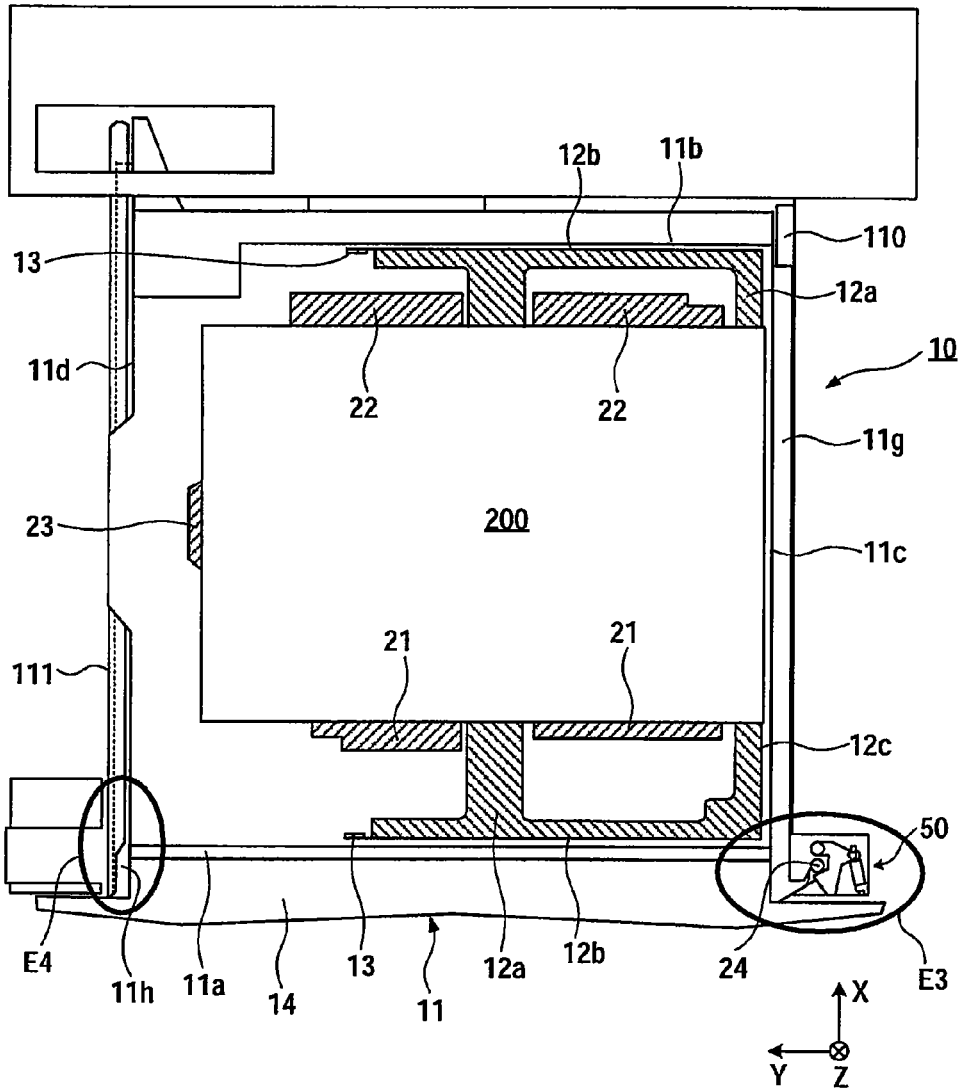
FIG. 14 is a diagram of a state in which a paper feeding cassette is inserted in an apparatus main body in a second embodiment of the present invention.

As shown in FIG. 14, a latch mechanism 50 is provided in the apparatus main body in which the paper feeding cassette 10 is inserted. The latch mechanism 50 holds the paper feeding cassette 10 in a state in which the paper feeding cassette 10 is inserted in the apparatus main body and prevents the paper feeding cassette 10 from carelessly coming off from the apparatus main body.

Flange sections 11*g* and 11*h* projecting to the outer side of the cassette case 11 are formed in the sidewalls 11*c* and lid of the cassette case 11. The flange sections 11*g* and 11*h* extend in the X direction. When the paper feeding cassette 10 is inserted into the apparatus main body, the flange sections 11*g* and 11*h* are supported by cassette rails 110 and 111 provided in the apparatus main body.

Figure 15:
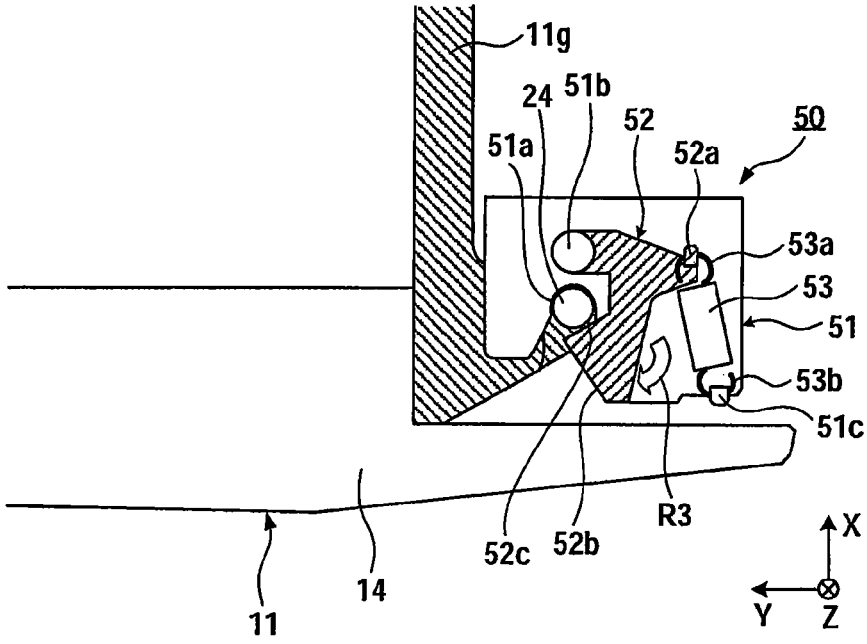
FIG. 15 is an enlarged view in an area E3 shown in FIG. 14 and is a diagram of a state in which the paper feeding cassette is inserted in the apparatus main body.
Figure 16:
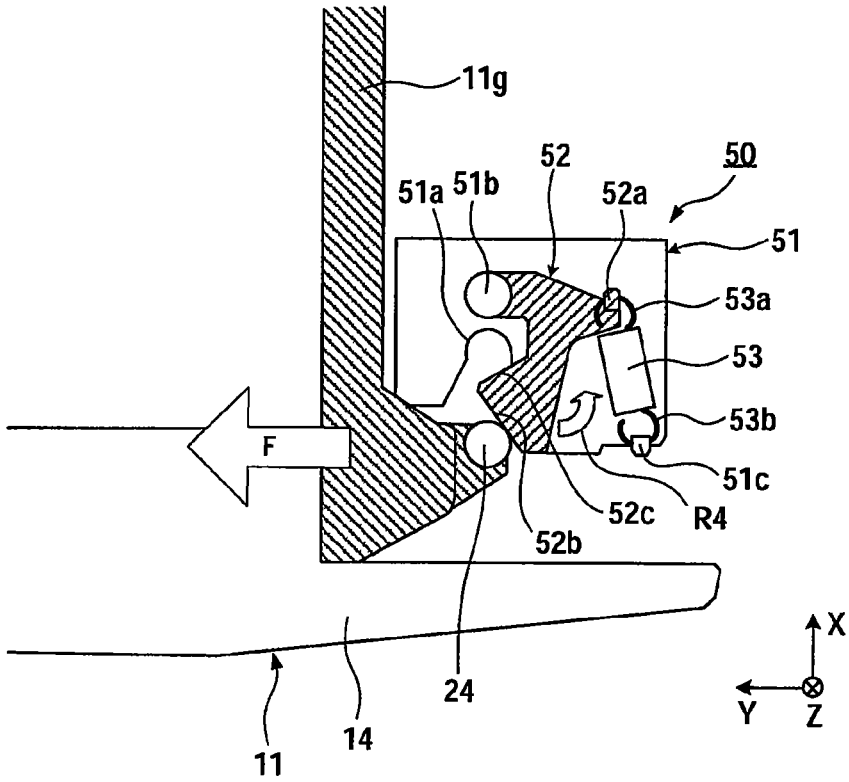
FIG. 16 is an enlarged view in the area E3 shown in FIG. 14 and is a diagram of a state before the paper feeding cassette is inserted in the apparatus main body.

As shown in FIGS. 15 and 16, a base member 51 of the latch mechanism 50 has a bearing section 51*a* in which a pin (a projection) 24 of the paper feeding cassette 10 enters when the paper feeding cassette 10 is inserted in the apparatus main body. The pin 24 is provided on the flange section 11*g* of the cassette case 11.

A holding lever 52 is attached to a shaft 51*b* formed in the base member 51 and rotates around the shaft 51*b*. The holding lever 52 is urged in a direction of an arrow R3 by a coil spring (an urging member) 53. Specifically, one end 53*a* of the coil spring 53 is attached to a supporting section 52*a* of the holding lever 52. The other end 53*b* of the coil spring 53 is attached to a supporting section 51*c* of the base member 51.

When the paper feeding cassette 10 is inserted in the apparatus main body, as shown in FIG. 15, the pin 24 is nipped by the bearing section 51*a* and the holding lever 52.

Operation in inserting the paper feeding cassette 10 into the apparatus main body is explained.

When the paper feeding cassette 10 is slid in the inserting direction (the X direction) in a state in which the flange sections 11*g* and 11*h* of the paper feeding cassette 10 are placed on the cassette rails 110 and 111, the pin 24 comes into contact with a guide slope 52*b* of the holding lever 52. When the paper feeding cassette 10 is further pushed in, the pin 24 pushes in the guide slope 52*b* to thereby rotate the holding lever 52 in a direction of an arrow RA against the urging force of the coil spring 53. Consequently, the pin 24 passes the guide slope 52*b* and comes into contact with the bearing section 51*a*.

When the pin 24 comes into contact with the bearing section 51*a*, force for pushing in the guide slope 52*b* by the pin 24 is released. The holding lever 52 rotates in the direction of the arrow R3 with the urging force of the coil spring 53. A holding slope 52*c* of the holding lever 52 comes into contact with the pin 24. The pin 24 is pushed in to the side of the bearing section 51*a* by the holding slope 52*c* and is in contact with the holding slope 52*c* and the bearing section 51*a*.

Operation in drawing out the paper feeding cassette 10 from the apparatus main body is explained.

When force for drawing out the paper feeding cassette 10 from the apparatus main body acts on the paper feeding cassette 10, the pin 24 pushes in the holding slope 52*c*, whereby the holding lever 52 rotates in the direction of the arrow R4. Consequently, the pin 24 passes the holding slope 52*c*. The holding of the pin 24 by the holding lever 52 is released.

When the pin 24 passes the holding slope 52*c*, the holding lever 52 rotates in the direction of the arrow R3 with the urging force of the coil spring 53 and returns to an initial position. The initial position is the position of the holding lever 52 in the latch mechanism 50 before the insertion of the paper feeding cassette 10 into the apparatus main body.

When the paper feeding cassette 10 is inserted into the apparatus main body, the guide slope 52*b* of the holding lever 52 is located on a moving track of the pin 24. Therefore, the pin 24 collides with the guide slope 52*b*. The guide slope 52*b* inclines with respect to a moving direction of the pin 24. Therefore, when the pin 24 collides with the guide slope 52*b*, force in a direction indicated by an arrow F in FIG. 16 is generated in the paper feeding cassette 10.

Figure 17:
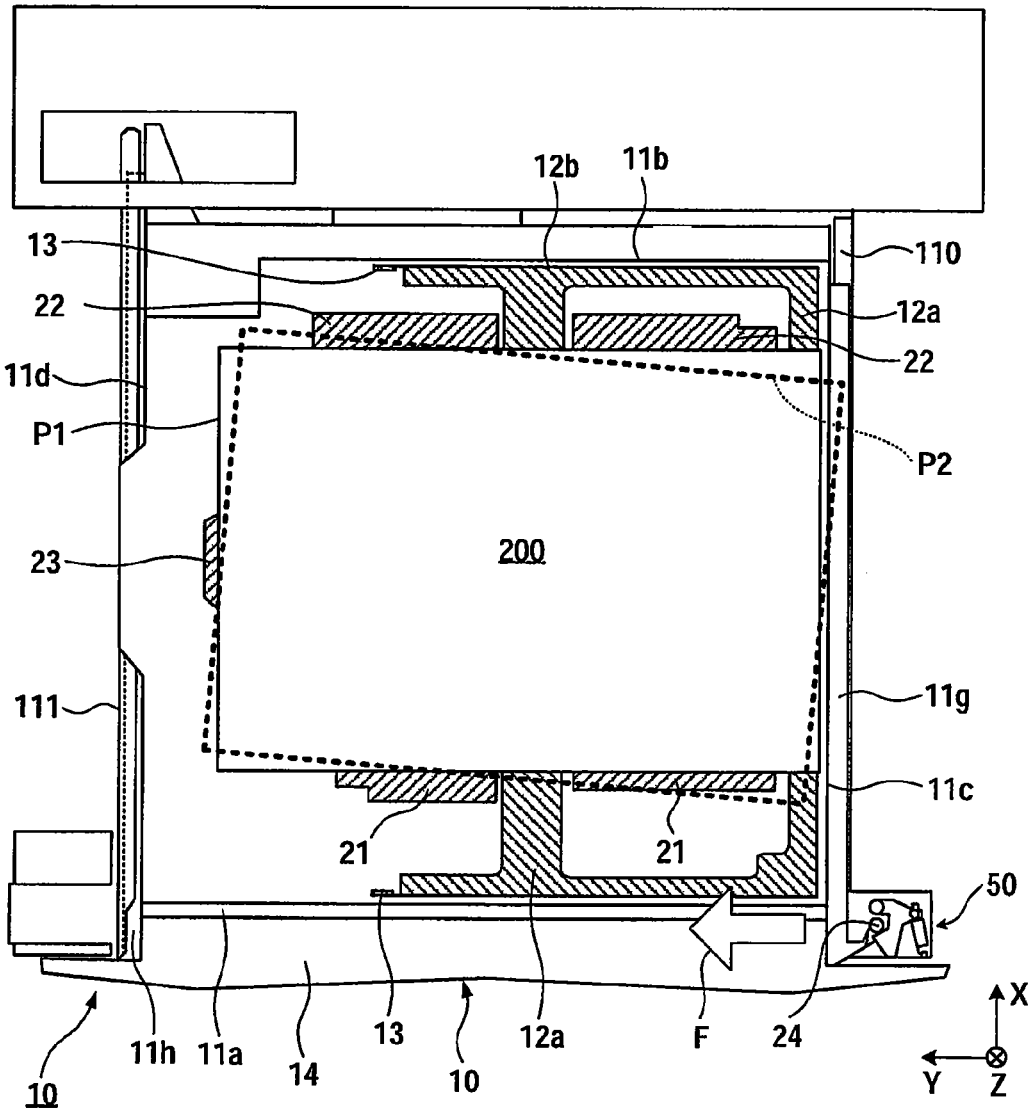
FIG. 17 is a diagram for explaining a phenomenon in which a shift of sheets occurs when the paper feeding cassette is inserted into the apparatus main body.

Depending on the magnitude of the force F, as shown in FIG. 17, the sheets 200 stacked in the paper feeding cassette 10 may shift from a position P1 to a position P2. The position P1 shown in FIG. 17 is a position of the sheets 200 positioned by the side guides 21 and 22 and the trailing end guide 23.

Figure 18:
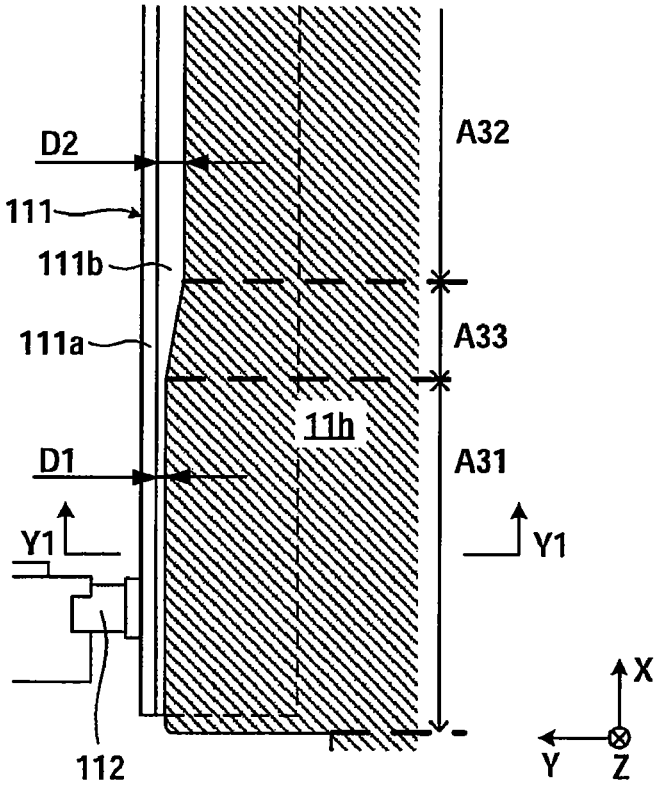
FIG. 18 is an enlarged view in an area E4 shown in FIG. 14.
Figure 19:
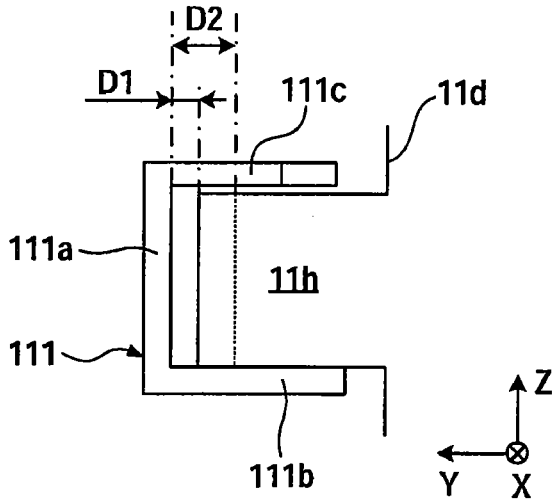
FIG. 19 is a schematic diagram of a section taken along Y1-Y1 in FIG. 18.

In this embodiment, to suppress the shift of the sheets 200, the flange section 11*h* of the cassette case 11 is formed in a shape shown in FIGS. 18 and 19. FIG. 18 is an enlarged view of an area E4 shown in FIG. 14. FIG. 19 is a diagram of a section taken along Y1-Y1 in FIG. 18.

The cassette rail 111 that supports the flange section 11*h* is supported on the apparatus main body via a supporting member 112. The cassette rail 111 has a side surface 111*a*, a bottom surface 111*b*, and an upper surface 111*c*.

The flange section 11*h* is located between the bottom surface 111*b* and the upper surface 111*c* and supported by the bottom surface 111*b*. The side surface 111*a* of the cassette rail 111 comes into contact with the flange section 11*h* to thereby suppress the paper feeding cassette 10 from shifting in the Y direction.

The flange section 11*h* has three areas (first to third areas) A31, A32, and A33. A distance D1 between the first area A31 and the side surface 111*a* of the cassette rail 111 is narrower than a distance D2 between the second area A32 and the side surface 111*a*. The third area A33 is located between the first area A31 and the second area A32. A distance between the third area A33 and the side surface 111*a* continuously changes within a range of the distance D1 to the distance D2.

The distance D2 is a distance set in advance to easily slide the flange section 11*h* relatively to the cassette rail 111. The distance D1 only has to be smaller than the distance D2 and can be set as appropriate.

When the pin 24 provided in the flange section 11*g* comes into contact with the guide slope 52*b* of the holding lever 52 (see FIG. 16), the first area A31 of the flange section 11*h* is opposed to the side surface 111*a* of the cassette rail 111. Therefore, when the paper feeding cassette 10 is subjected to the force F shown in FIG. 17, the first area A31 of the flange section 11*h* comes into contact with the side surface 111*a* of the cassette rail 111.

If the flange section 11*h* is formed only by the second area A32, when the paper feeding cassette 10 is subjected to the force F, the paper feeding cassette 10 shifts in the Y direction by the distance D2.

On the other hand, in this embodiment, the paper feeding cassette 10 shifts only by the distance D1 smaller than the distance D2. Therefore, immediately after the paper feeding cassette 10 is subjected to the force F shown in FIG. 17, the first area A31 of the flange section 11*h* can be brought into contact with the side surface 111*a* of the cassette rail 111 to allow the force F to escape to the cassette rail 111. Consequently, it is possible to suppress the sheets 200 from shifting when the paper feeding cassette 10 is subjected to the force F.

AS the distance D1 is set smaller, the first area A31 of the flange section 11*h* can be more quickly brought into contact with the side surface 111*a* of the cassette rail 111. In other words, the force F acting on the paper feeding cassette 10 can be allowed to quickly escape to the cassette rail 111. Since the flange section 11*h* needs to slide relatively to the cassette rail 111, the distance D1 is desirably longer than zero.

On the other hand, since the third area A33 is provided in the flange section 11*h*, when the paper feeding cassette 10 is inserted into the apparatus main body, the flange section 11*h* can be smoothly slid relatively to the cassette rail 111. The third area A33 can be omitted.

Until the pin 24 comes into contact with the guide slope 52*b* of the holding lever 52, the second area A32 of the flange section 11*h* is opposed to the side surface 111*a* of the cassette rail 111. At this point, a space between the flange section 11*h* and the cassette rail 111 is the distance D2. Therefore, the flange section 11*h* (the paper feeding cassette 10) can be smoothly slid relatively to the cassette rail 111.

In this embodiment, the first area A31 is provided at one end in the X direction in the flange section 11*h*. However, the position of the first area A31 is not limited to this. When the pin 24 comes into contact with the holding lever 52, the first area A31 only has to be opposed to the side surface 111*a* of the cassette rail 111. Specifically, the first area A31 can be provided in a position different from the one end of the flange section 11*h* in the X direction. The first area A31 can be provided in plural positions.

In this embodiment, the pin 24 is used as a member held by the latch mechanism 50. However, the member is not limited to this. A portion (a projection) held by the latch mechanism 50 only has to be provided in the cassette case 11. For example, a pawl section (a projection) that engages with the holding lever 52 can be formed in the flange section 11*g* of the cassette case 11.

Third Embodiment

A third embodiment of the present invention is explained. This embodiment relates to a structure for detecting an insertion state of the paper feeding cassette 10 when the paper feeding cassette 10 is inserted in the apparatus main body and detecting a size of sheets stacked in the paper feeding cassette 10. Members having the same functions as those of the members explained above in the embodiments are denoted by the same reference numerals and signs.

Figure 20:
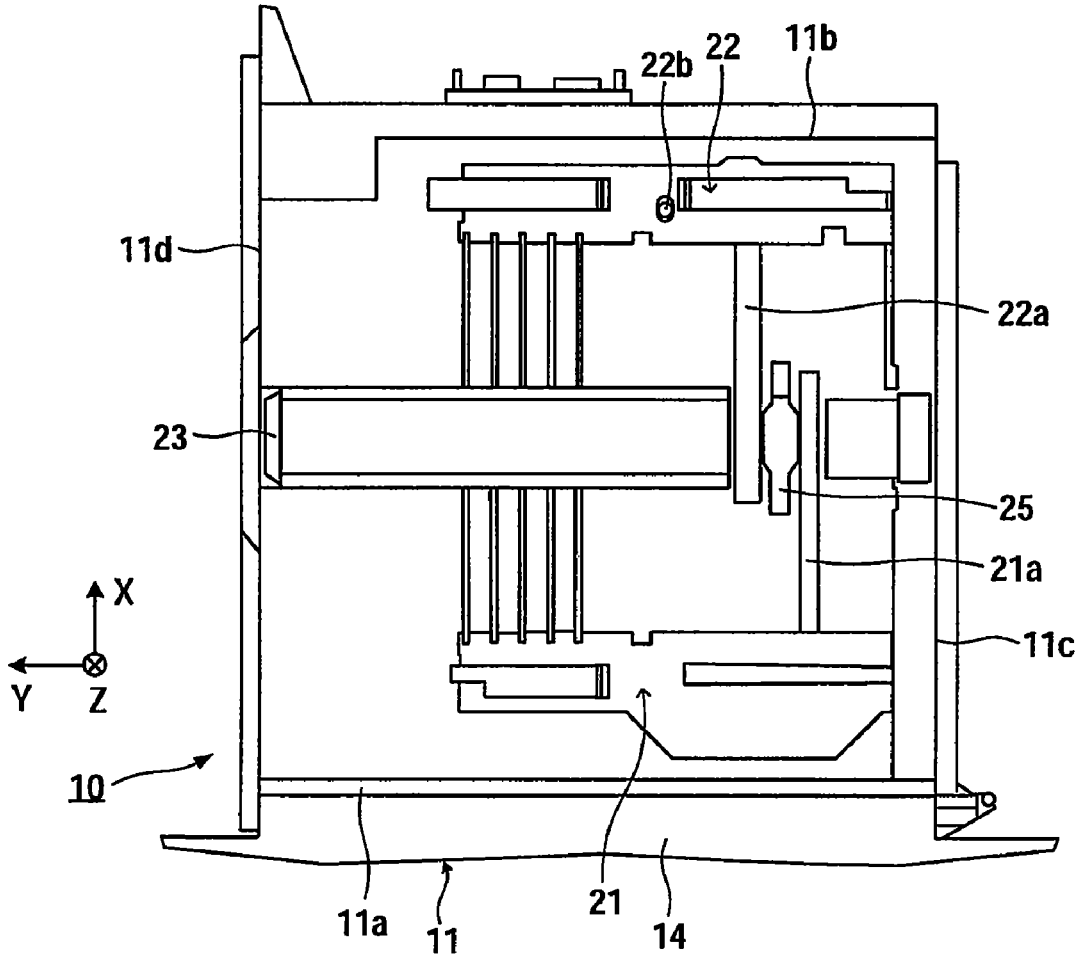
FIG. 20 is a top view of an internal structure of a paper feeding cassette in a third embodiment of the present invention.
Figure 21:
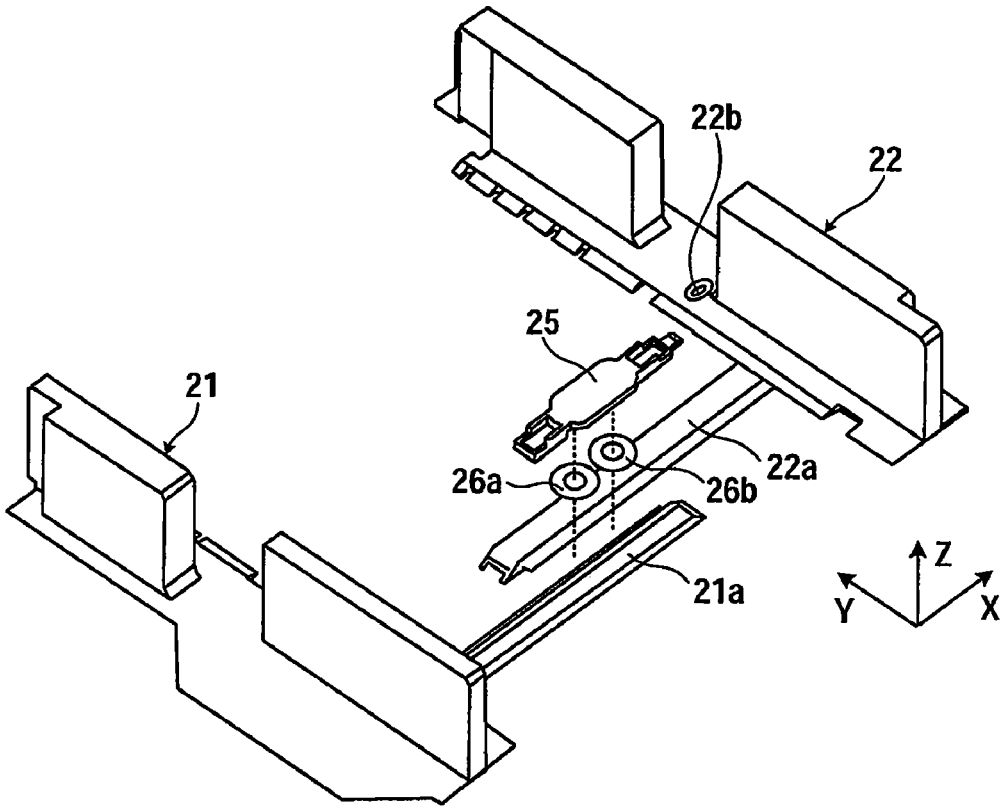
FIG. 21 is a perspective view of the structure of a side guide.

As shown in FIGS. 20 and 21, the first side guide 21 includes a rack 21*a* that extends in the X direction to the second side guide 22. The rack 21*a* meshes with pinion gears 26*a* and 26*b*. The pinion gears 26*a* and 26*b* are attached to the cassette case 11 in a state in which the pinion gears 26*a* and 26*b* can be rotated by a supporting member 25.

The second side guide 22 includes a rack 22*a* that extends in the X direction to the first side guide 21. The rack 22*a* meshes with the pinion gears 26*a* and 26*b*.

When at least one of the side guides 21 and 22 is slid in the X direction, the two side guides 21 and 22 come close to or separate from each other. A space between the pair of side guides 21 and 22 can be changed according to a size of sheets stacked in the paper feeding cassette 10.

Figure 22:
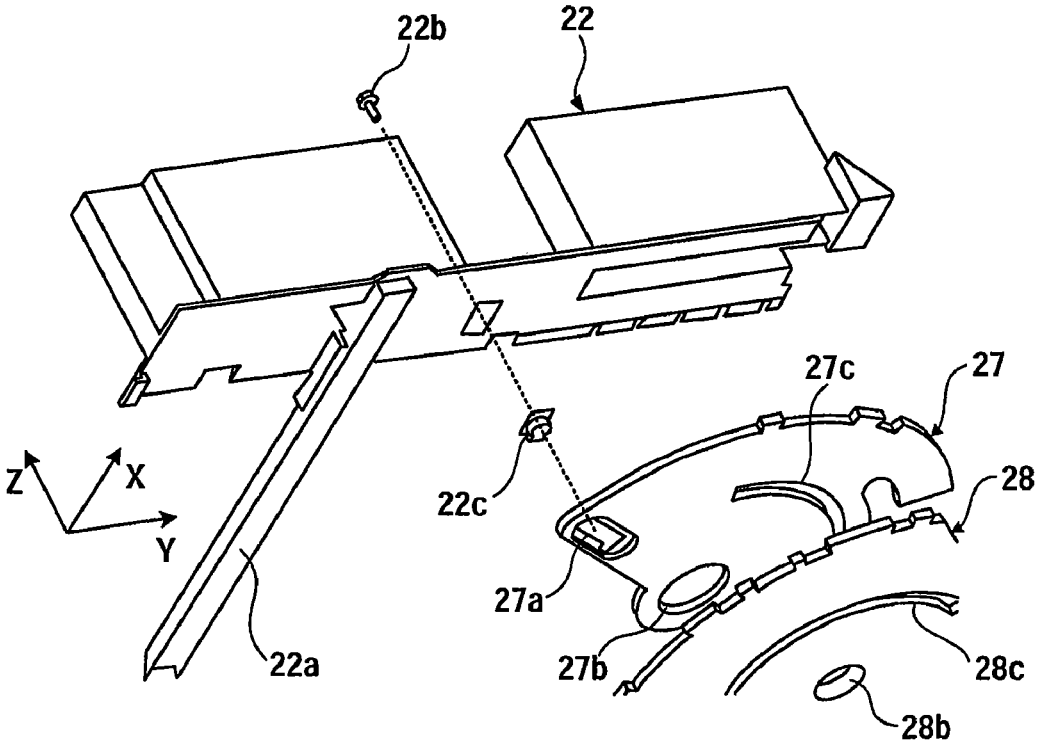
FIG. 22 is a disassembled perspective view of the structure of the side guide and a detection dial.
Figure 23:
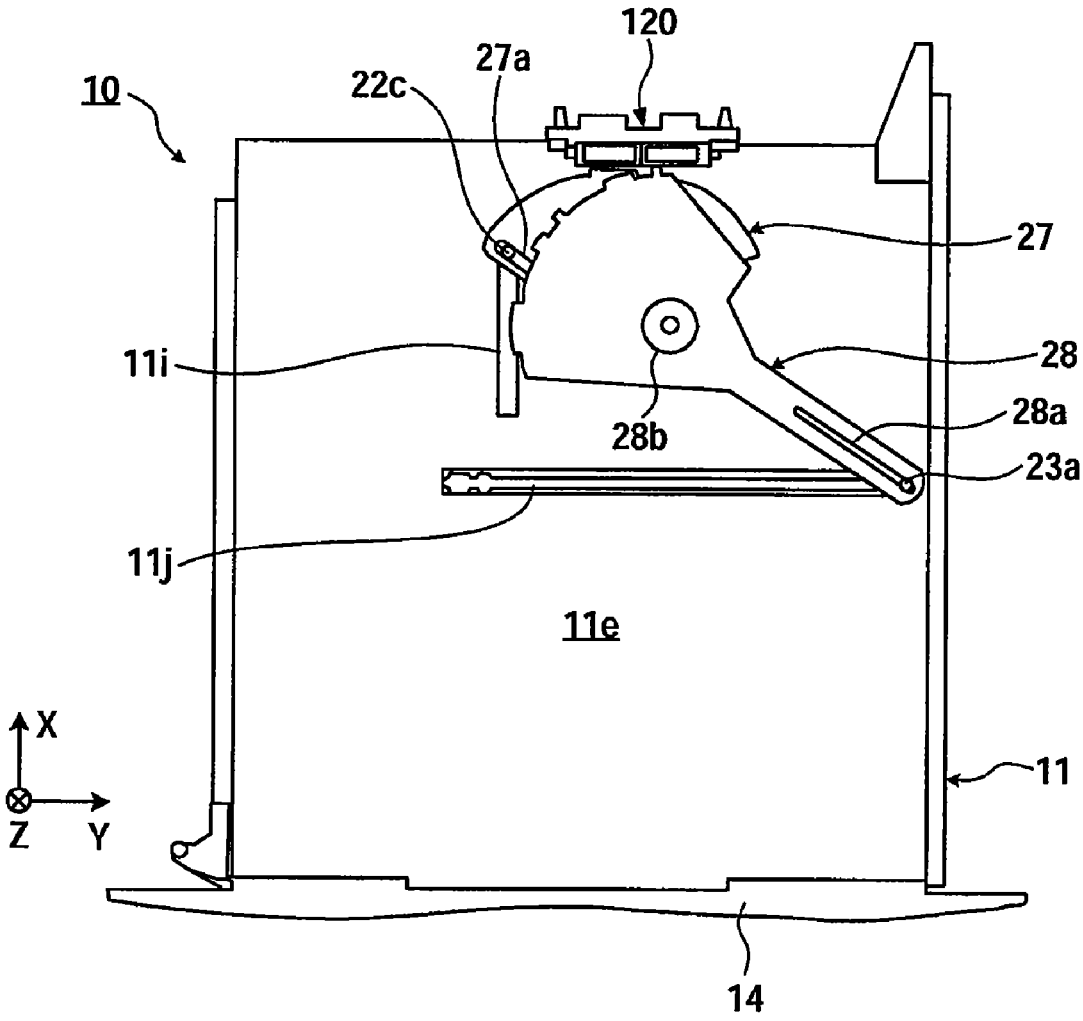
FIG. 23 is a diagram of the structure on the rear surface of the paper feeding cassette.

As shown in FIG. 22, a coupling pin 22*c* is fixed to the rear surface of the second side guide 22 by a screw 22*b*. The coupling pin 22*c* pierces through a guide hole 11*i* (see FIG. 23) of the cassette case 11 and engages with a driving hole 27*a* of a first detection dial 27. The guide hole 11*i* extends in the X direction.

An opening 27*b* of the first detection dial 27 engages with a shaft section (not shown in the figure) formed on the rear surface of the cassette case 11. The first detection dial 27 can rotate around the shaft section. When the second side guide 22 is slid in the X direction, the coupling pin 22*c* pushes in the driving hole 27*a* to thereby rotate the first detection dial 27.

A guide hole 27*c* is formed in the first detection dial 27. The guide hole 27*c* extends along the circumference of a rotation axis of the first detection dial 27. A guide projection (not shown in the figure) formed on the rear surface of the cassette case 11 engages with the guide hole 27*c*. The first detection dial 27 can be smoothly rotated by engaging the guide projection with the guide hole 27*c*.

A coupling pin 23*a* is fixed to the rear surface of the trailing end guide 23. The coupling pin 23*a* pierces through the guide hole 11*j* of the cassette case 11 and engages with a driving hole 28*a* of a second detection dial 28 (see FIG. 23). The guide hole 11*j* extends in the Y direction.

An opening 28*b* of the second detection dial 28 engages with the shaft section formed on the rear surface of the cassette case 11. The second detection dial 28 can rotate around the shaft section. A rotation axis of the second detection dial 28 is arranged on an axis different from the rotation axis of the first detection dial 27. In addition, the first detection dial 27 and the second detection dial 28 are arranged to overlap in the Z direction.

When the trailing end guide 23 is slid in the Y direction, the coupling pin 23*a* pushes in the driving hole 28*a* to thereby rotate the second detection dial 28. A guide hole 28*c* is formed in the second detection dial 28. The guide hole 28*c* extends along the circumference of a rotation axis of the second detection dial 28. A guide projection 11*k* (see FIG. 24) formed on the rear surface of the cassette case 11 engages with the guide hole 28*c*. The second detection dial 28 can be smoothly rotated by engaging the guide projection 11*k* with the guide hole 28*c*. The first detection dial 27 is formed in a shape that does not interfere with the guide projection that engages with the guide hole 28*c*.

Figure 24:
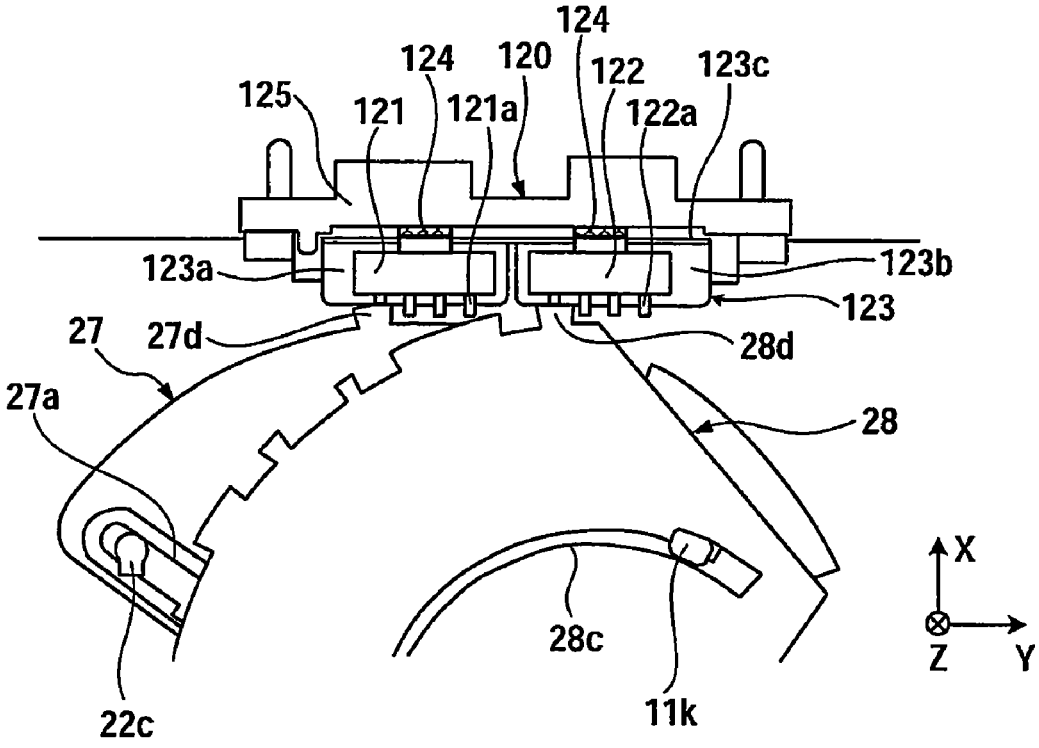
FIG. 24 is a diagram of the structure of a switch module and the detection dial.
Figure 25:
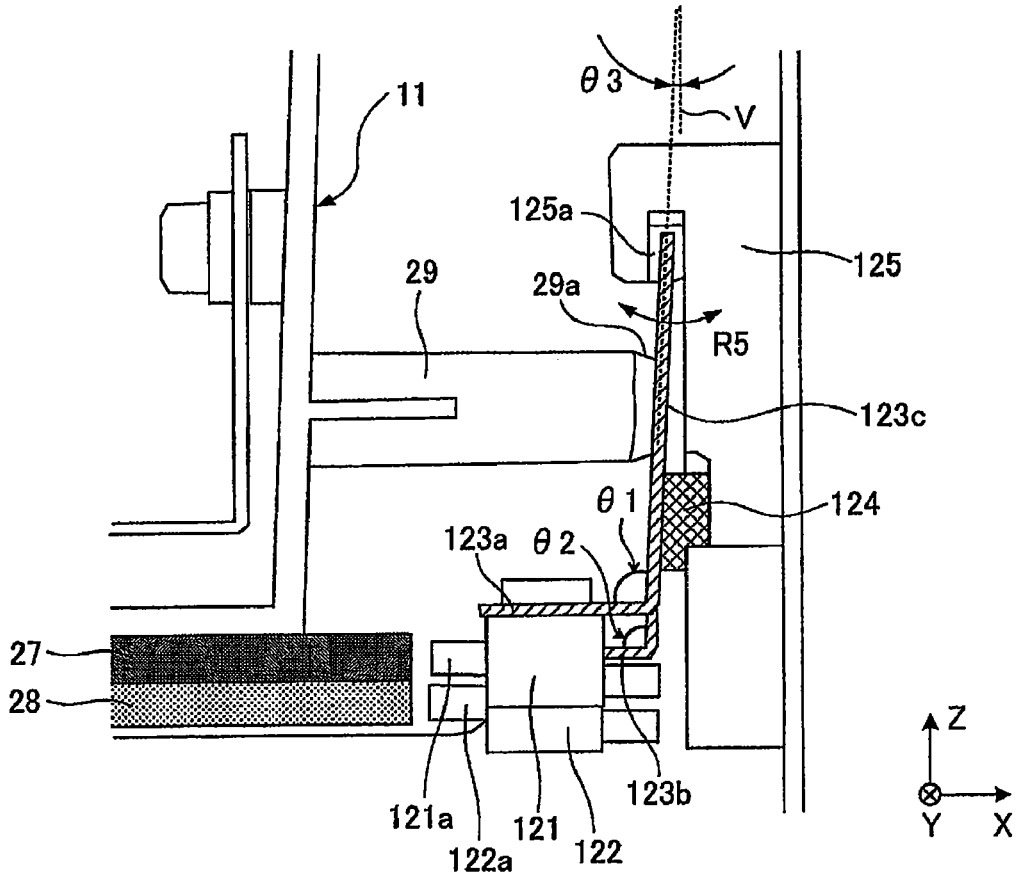
FIG. 25 is a side view of the structure of the switch module and the detection dial.
Figure 26:
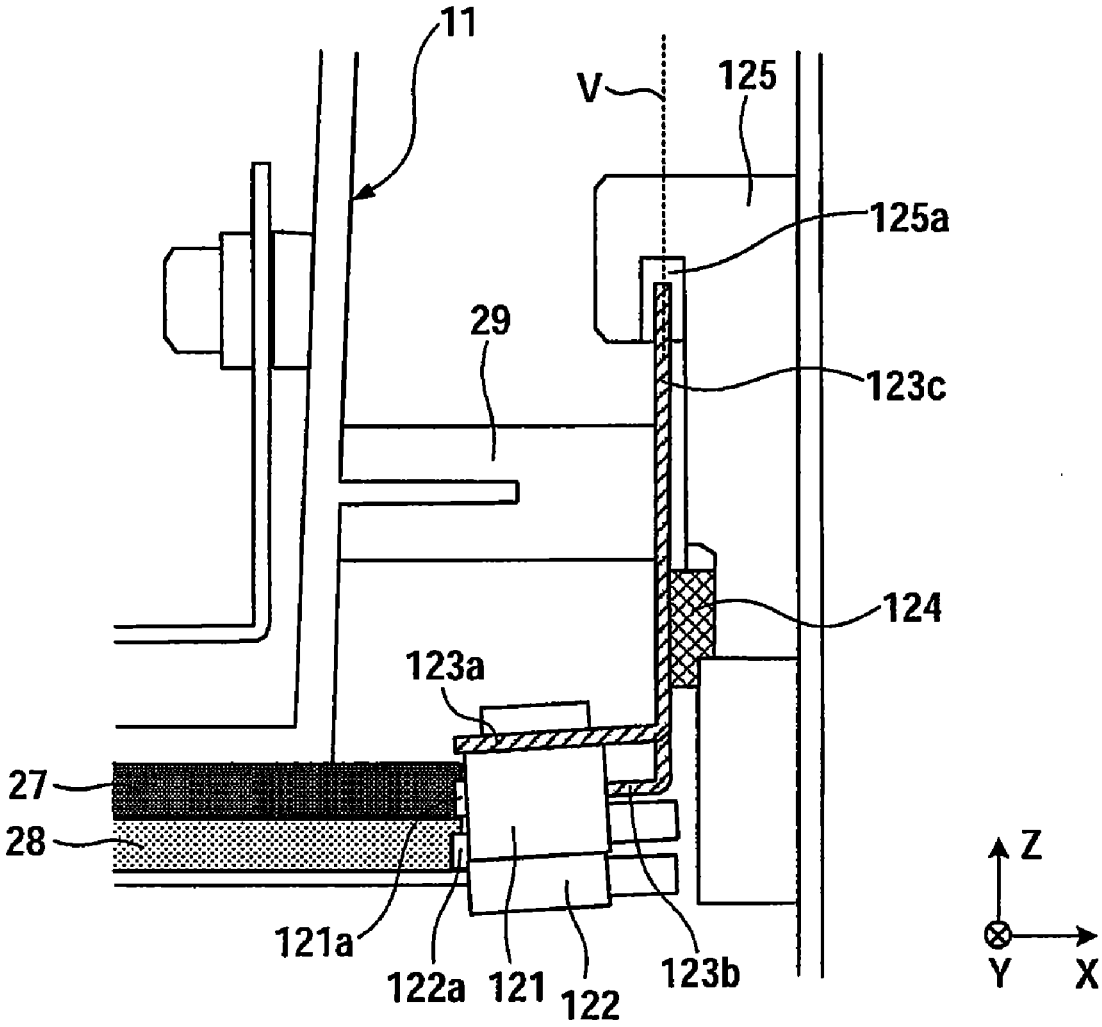
FIG. 26 is a side view of the structure of the switch module and the detection dial.

On the other hand, a switch module 120 is arranged in an apparatus main body 140 (see FIG. 25). The switch module 120 is used for detecting a size of sheets stacked in the paper feeding cassette 10. As shown in FIG. 24, the switch module 120 includes a first switch element 121 and a second switch element 122.

The first switch element 121 has plural pins 121*a*. When the pins 121*a* are pushed in, output signals corresponding to the pins 121*a* are switched. When the paper feeding cassette 10 is in a predetermined insertion position, the pin 121*a* is pushed in by the projection 27*d* of the first detection dial 27.

The pin 121*a* pushed in by the projection 27*d* is different depending on a rotation angle of the first detection dial 27. The rotation angle of the first detection dial 27 changes according to a position of the side guide 22, in other words, a size in the X direction of sheets stacked on the paper feeding cassette 10. Therefore, the size in the X direction of the sheets can be determined by determining a signal pattern formed by on and off states of the plural pins 121*a*. This determination can be performed by a controller (not shown in the figure) connected to the first switch element 121.

The second switch element 122 has plural pins 122*a*. When the pins 122*a* are pushed in, output signals corresponding to the pins 122*a* are switched. When the paper feeding cassette 10 is in the predetermined insertion position, the pin 122*a* is pushed in by a projection 28*d* of the second detection dial 28.

The pin 122*a* pushed in by the projection 28*d* is different depending on a rotation angle of the second detection dial 28. The rotation angle of the second detection dial 28 changes according to a position of the trailing end guide 23, in other words, a size in the Y direction of sheets stacked on the paper feeding cassette 10. Therefore, the size in the Y direction of the sheets can be determined by determining a signal pattern formed by on and off states of the plural pins 122*a*. This determination can be performed by a controller (not shown in the figure) connected to the second switch element 122.

The first switch element 121 and the second switch element 122 are supported by a supporting plate 123. As shown in FIG. 25, the supporting plate 123 has a first area 123*a* in which the first switch element 121 is fixed, a second area 123*b* in which the second switch element 122 is fixed, and a third area 123*c* connected to the first area 123*a* and the second area 123*b*.

An angle θ1 between the first area 123*a* and the third area 123*c* is set larger than 90 degrees. Similarly, an angle θ2 between the second area 123*b* and the third area 123*c* is set larger than 90 degrees. The angle θ1 and the angle θ2 are substantially equal.

One end of a spring 124 is fixed to the third area 123*c* of the supporting plate 123. The other end of the spring 124 is fixed to a holder 125. The spring 124 urges the supporting plate 123 in a direction away from the holder 125. In a state in which the detection dials 27 and 28 are not in contact with the switch elements 121 and 122 (a state shown in FIG. 25), the third area 123*c* of the supporting plate 123 tilts by the angle θ3 with respect to a vertical surface (a Y-Z plane) V.

One end of the supporting plate 123 (the third area 123*c*) is held by a holding section 125*a* of the holder 125. The supporting plate 123 can swing in a direction indicated by an arrow R5 with a portion held by the holding section 125*a* as a fulcrum.

When the angles θ1 and θ2 are set as explained above, even if the supporting plate 123 swings, the pins 121*a* and 122*a* of the switch elements 121 and 122 can be maintained in a state in which the pins 121*a* and 122*a* are set in contact with the detection dials 27 and 28.

Figure 27:
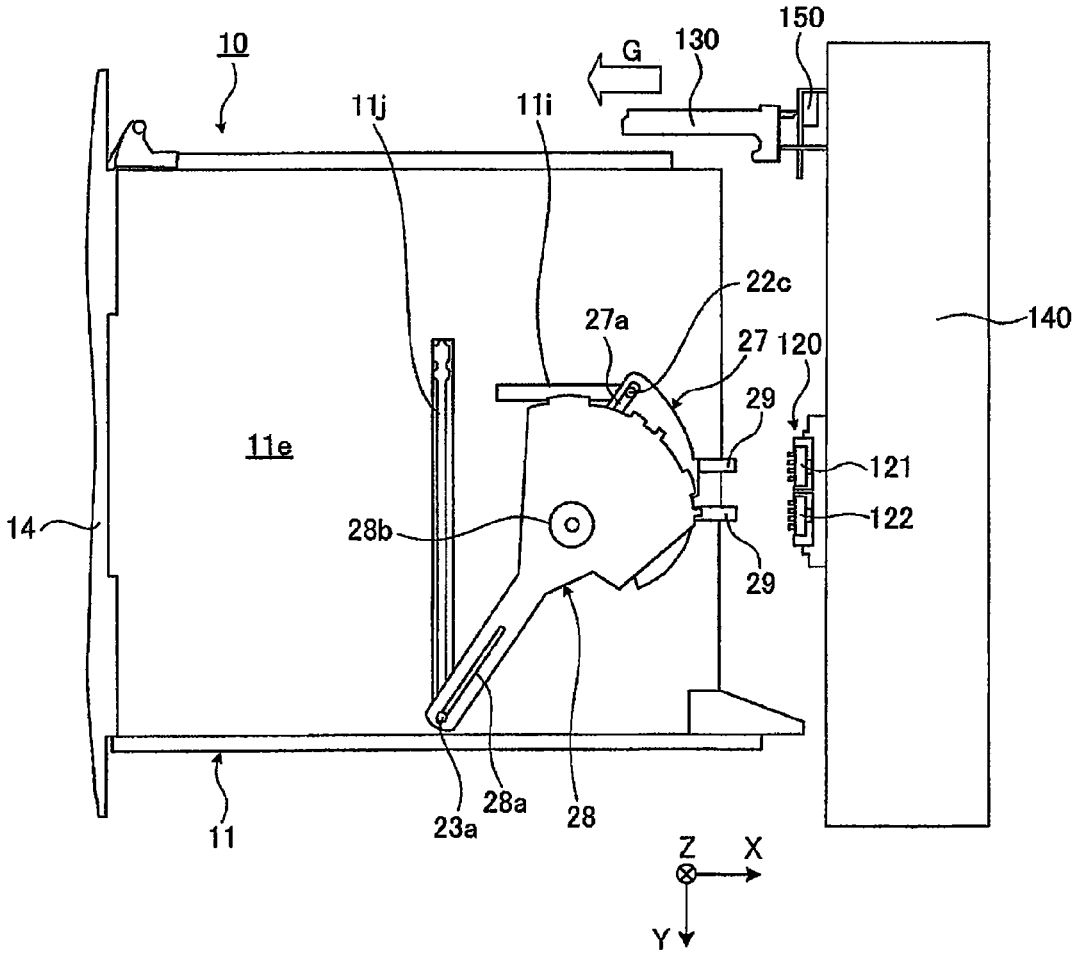
FIG. 27 is a diagram of the structure of the switch module and a detection sensor.

A positioning hole (not shown in the figure) is formed in the third area 123*c* of the supporting plate 123. A positioning pin 29 formed in the cassette case 11 enters the positioning hole. The positioning pin 29 extends in the X direction. As shown in FIG. 27, two positioning pins 29 are provided. It is possible to make it easy to bring the detection dials 27 and 28 into contact with the pins 121*a* and 122*a* of the switch elements 121 and 122 by causing the positioning pins 29 to enter positioning holes of the supporting plate 123. Slopes 29*a* are formed at the distal ends of the positioning pins 29 to make it easy to cause the positioning pins 29 to enter the positioning holes.

When the paper feeding cassette 10 is moved to the predetermined insertion position, the detection dials 27 and 28 push in the pins 121*a* and 122*a* of the switch elements 121 and 122. After completely pushing in the pins 121*a* and 122*a*, the detection dials 27 and 28 push in the supporting plate 123 via the switch elements 121 and 122 to thereby swing the supporting plate 123.

On the other hand, as shown in FIG. 27, a detection lever (a slide member) 130 is attached to the apparatus main body 140 in a state in which the detection lever 130 can move in the X direction. The detection lever 130 is urged by a spring (not shown in the figure) in a direction indicated by an arrow G. A guide hole 131 of the detection lever 130 shown in FIGS. 28 and 29 engage with a guide projection (not shown in the figure) formed in the apparatus main body to thereby allow the detection lever 130 to move in the X direction.

Figure 28:
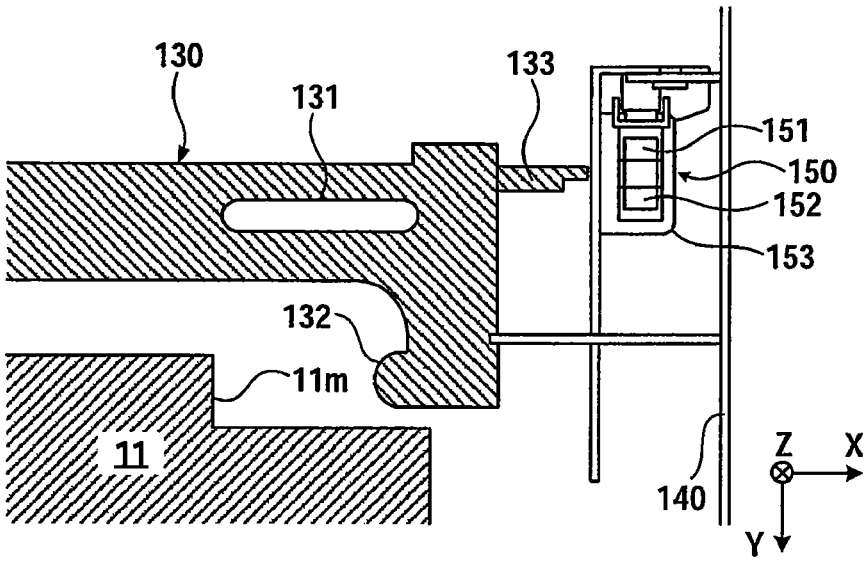
FIG. 28 is a diagram of the structure of the detection sensor and a detection lever.

When the paper feeding cassette 10 is slid to the predetermined insertion position, an end face 11*m* of the cassette case 11 comes into contact with an arm 132 of the detection lever 130 to push in the arm 132 (see FIG. 28). Consequently, the detection lever 130 moves in the same direction as the moving direction of the paper feeding cassette 10.

A light blocking section 133 is provided at an end of the detection lever 130. A detection sensor 150 is provided in the apparatus main body 140. The detection sensor 150 is used for detecting that the paper feeding cassette 10 is in the predetermined insertion position. The detection sensor 150 includes a light projecting element 151 that irradiates detection light and a light receiving element 152 that receives detection light from the light projecting element 151. The light projecting element 151 and the light receiving element 152 are fixed to a substrate 153.

Figure 29:
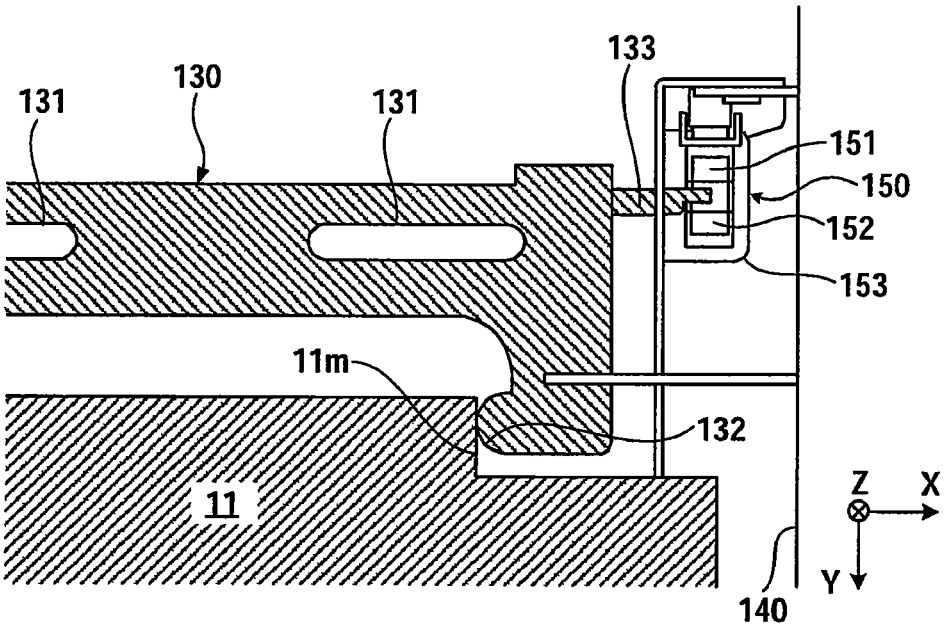
FIG. 29 is a diagram of the structure of the detection sensor and the detection lever.

In a state in which the paper feeding cassette 10 does not move to the insertion position (a state shown in FIG. 28), the light blocking section 133 is separated from the detection sensor 150. The detection light irradiated from the light projecting element 151 reaches the light receiving element 152. On the other hand, when the paper feeding cassette 10 moves to the insertion position, as shown in FIG. 29, the light blocking section 133 enters between the light projecting element 151 and the light receiving element 152. Consequently, the detection light traveling from the light projecting element 151 to the light receiving element 152 is blocked by the light blocking section 133.

Since the detection lever 130 is urged in a direction away from the detection sensor 150, if the paper feeding cassette 10 is drawn out from the apparatus main body 140, the light blocking section 133 of the detection lever 130 retracts from the space between the light projecting element 151 and the light receiving element 152. Consequently, the detection light from the light projecting element 151 reaches the light receiving element 152.

As explained above, the output of the detection sensor 150 is switched according to the position of the paper feeding cassette 10. Therefore, it is possible to determine, on the basis of an output signal of the detection sensor 150, whether the paper feeding cassette 10 moves to the insertion position. This determination is performed by a controller (not shown in the figure) connected to the detection sensor 150.

In the configuration including the switch module 120 and the detection sensor 150, it is likely that deficiencies explained below occur because of attachment errors and the like of the switch module 120 and the detection sensor 150.

For example, regardless of the fact that the light blocking section 133 of the detection lever 130 is located between the light projecting element 151 and the light receiving element 152, the projections 27*d* and 28*d* of the detection dials 27 and 28 do not sufficiently push in the pins 121*a* and 122*a* of the switch elements 121 and 122. In this case, it is likely that the detection by the switch elements 121 and 122 is not performed or wrong detection is performed.

In this embodiment, as explained above, the switch elements 121 and 122 are displaced in the slide direction of the paper feeding cassette 10 (the X direction) by swinging the supporting plate 123. The attachment errors of the detection switch 150 and the switch module 120 can be absorbed by displacing the switch elements 121 and 122 in the X direction.

Specifically, in a state in which the light blocking section 133 of the detection lever 130 is located between the light projecting element 151 and the light receiving element 152 (a state shown in FIG. 29), the detection dials 27 and 28 push in the switch elements 121 and 122 to displace the switch elements 121 and 122 in the X direction. Consequently, the pins 121*a* and 122*a* of the switch elements 121 and 122 can be surely pushed in by the detection dials 27 and 28. A size of sheets can be accurately detected on the basis of output signals of the switch elements 121 and 122.

In this embodiment, the supporting plate 123 is swung. However, the present invention is not limited to this. The switch elements 121 and 122 only have to be displaced in the X direction. For example, the plate that supports the switch elements 121 and 122 can be translated in the X direction.

It is possible to detect, using a component different from the detection sensor 150 explained in this embodiment, that the paper feeding cassette 10 is in the insertion position. For example, the detection light from the light projecting element 151 can be reflected on a reflecting section (equivalent to the light blocking section) of the detection lever 133 to cause the detection light to reach the light receiving element 152. A sensor that switches an output signal according to switching of contact and non-contact can be used instead of an optical sensor.

The present invention has been explained in detail with reference to the specific embodiments. However, it would be obvious to those skilled in the art that various alterations and modifications are possible without departing from the spirit and the scope of the present invention.

What is claimed is:

1. A paper feeding apparatus comprising:

a paper feeding cassette configured to be inserted in and removed from an apparatus main body by slide operation and have a first sidewall and a second sidewall opposed to each other in a direction orthogonal to a sliding direction;

a cassette rail configured to have a bottom surface that supports a flange section projecting from the first sidewall and a side surface opposed to a distal end surface of the flange section; and a holding lever configured to come into contact with a projection formed on the second sidewall, when the paper feeding cassette is inserted, to thereby rotate around an axis orthogonal to a slide surface of the paper feeding cassette and configured to detachably hold the projection, wherein the flange section projects to an outer side of the paper feeding cassette from the first sidewall, the distal end surface of the flange section including areas that have different distances to the side surface of the cassette rail when the projection comes into contact with the holding lever, the area having the smallest distance to the side surface of the cassette rail being opposed to the side surface of the cassette rail when the projection comes into contact with the holding lever.

2. The apparatus according to claim 1, wherein, when the paper feeding cassette is inserted into the apparatus main body, the holding lever is pushed in by the projection to thereby rotate in a direction away from the second sidewall.

3. The apparatus according to claim 2, further comprising an urging member configured to urge the holding lever in a direction towards the second sidewall.

4. The apparatus according to claim 1, wherein the distal end surface of the flange section has a first area which is the area having the smallest distance to the side surface of the cassette rail, a second area that is most distant from the side surface of the cassette rail, and a third area that is located between the first area and the second area and a distance of which to the side surface of the cassette rail continuously changes.

5. The apparatus according to claim 4, wherein the first area is formed at one end of the distal end surface of the flange section in the sliding direction of the paper feeding cassette.

* * * * *